United States Patent [19]

Rydahl

[11] 4,304,098

[45] Dec. 8, 1981

[54] METHOD AND APPARATUS FOR DEFROSTING COOLING ELEMENTS IN AN OPEN TYPE FREEZER CHEST

[75] Inventor: Gosta R. Rydahl, Vintrie, Sweden

[73] Assignee: Aktiebolaget Electrolux, Stockholm, Sweden

[21] Appl. No.: 66,301

[22] Filed: Aug. 13, 1979

Related U.S. Application Data

[63] Continuation of Ser. No. 874,217, Feb. 1, 1978, abandoned.

[51] Int. Cl.[3] ..... A47F 3/04

[52] U.S. Cl. ..... 62/82; 62/151; 62/186

[58] Field of Search ..... 62/282, 82, 256, 186, 62/151

[56] References Cited

U.S. PATENT DOCUMENTS

| | | | |
|---|---|---|---|
| 2,725,726 | 12/1955 | Swanson | 62/256 X |
| 3,464,224 | 9/1969 | Swanson | 62/80 |
| 3,845,637 | 11/1974 | Shepherd | 62/186 X |
| 3,850,003 | 11/1974 | Beckwith et al. | 62/256 X |
| 3,937,033 | 2/1976 | Beckwith et al. | 62/256 X |
| 4,026,121 | 5/1977 | Aokage et al. | 62/256 X |
| 4,120,174 | 10/1978 | Johnston | 62/325 X |
| 4,182,130 | 1/1980 | Ljung | 62/256 X |

*Primary Examiner*—William E. Tapolcai, Jr.
*Attorney, Agent, or Firm*—Alfred E. Miller

[57] ABSTRACT

A method and apparatus for defrosting cooling elements in a freezer chest of the type displaying frozen food items. The chest, having an open top, is provided with a channel around the food items through which air is circulated by means of a fan. The air is also directed over the open top of the freezer. Upon the defrost cycle, the cooling elements are shut down, and the air flow is reversed and directed away from the food items whereby air is drawn into the channel from the atmosphere outside of the freezer chest.

4 Claims, 7 Drawing Figures

Fig. 4a.
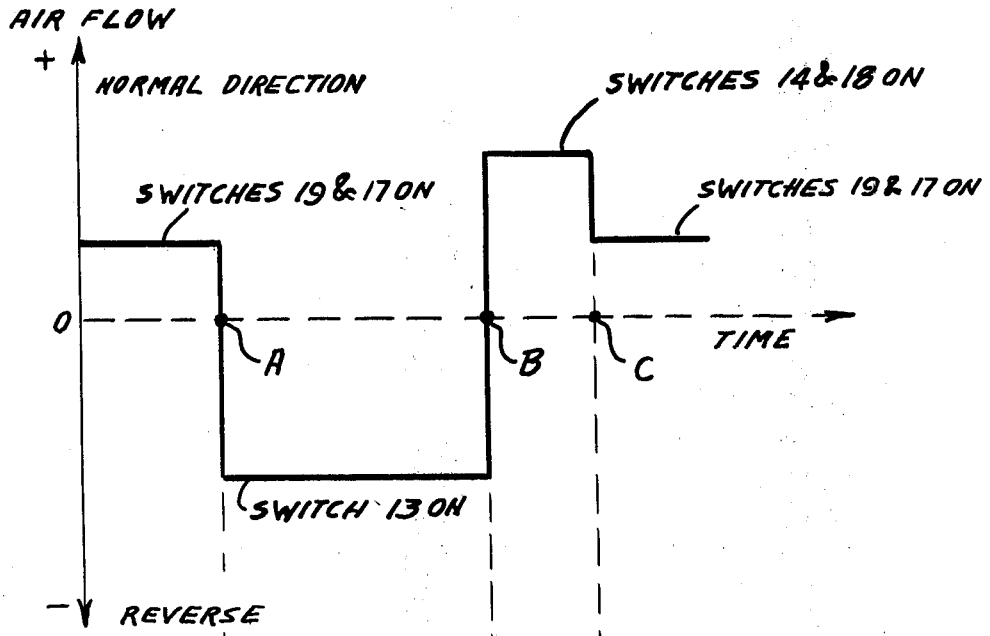
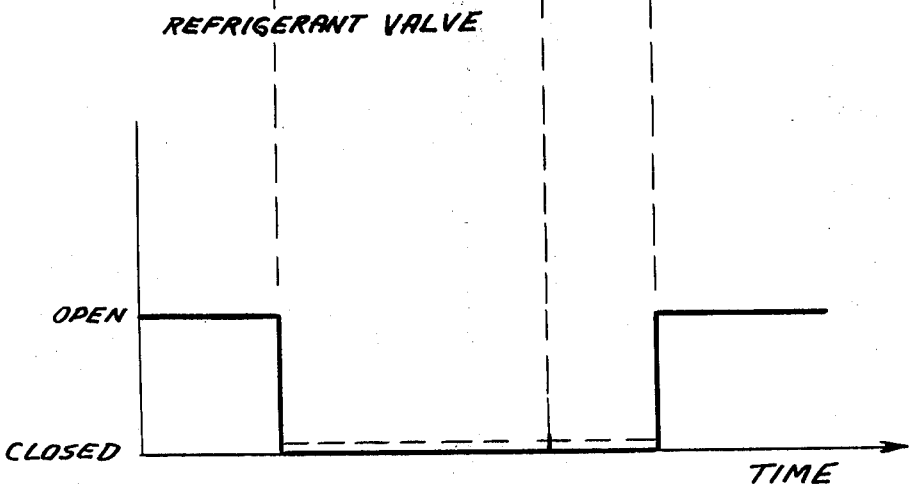
Fig. 5a.

METHOD AND APPARATUS FOR DEFROSTING COOLING ELEMENTS IN AN OPEN TYPE FREEZER CHEST

This is a continuation of application Ser. No. 874,217, filed Feb. 1, 1978, now abandoned.

BACKGROUND OF THE INVENTION

Frozen food display chests are common, especially in supermarkets, and in order to cool this open-type of freezer chest circulating air is utilized having a moisture content which will gradually settle and form frost on the cooling elements in the air channels within the freezer chest. Consequently, these freezer chest units have to be defrosted at regular intervals in order to maintain their proper cooling effect. Thus, in order to achieve a rapid defrosting of freezer chests, electric heaters, for example, have been used, which are placed close to the cooling elements. The compressor is then shut down and heat energy is supplied to the heaters. The ventilating fans are kept in operation so that air circulation continues. In this manner a comparatively rapid defrosting of the cooling elements of a freezer chest is achieved, however at the same time considerable energy has to be supplied to the heaters, together with an expensive assembly of heaters with connecting wires. Therefore, in order to reduce or eliminate the supply of electric energy, it has been proposed to use heat from the atmosphere for heating the freezer chest. In order to achieve this objective special air channels have to be provided in the freezer chest for supplying warm air from the atmosphere and discharging the air cooled by the cooling elements so that there will be no air circulation. Thus, the construction becomes rather complicated because, not only additional air channels are required for defrosting, but also a system of movable flaps or guides is essential. The latter have to be adjusted before and after defrosting so that the desired air passages are created. Obviously, the above described defrosting devices involve an increased cost for the freezer chest and furthermore they add to the risk of operation interruption. In addition, the above-mentioned devices cause an increased need for supervision of the defrosting operation.

The present invention relates to an apparatus and method for defrosting cooling elements in an open-type freezer chest in which air is caused to circulate about frozen food items by means of a fan. The air flow additionally moves over the open side of the freezer chest.

A feature of the present invention is to provide defrosting of an open-type freezer display chest by relatively simple and reliable means, without any significant increase in cost, as well as rated input.

Another feature of this invention is that in the defrosting cycle the cooling elements are shut down and the air in the channel is caused to flow by means of fans in a direction opposite to its flow direction during normal operation. Thus, the air cooled by the cooling elements are caused by guides to flow out of the circulation path in a direction away from the frozen items. Furthermore, when this occurs, air from the ambient is drawn in at the place or places where air was previously blown out.

A further feature of the present invention is to provide an open-type freezer chest which has means for reversing the direction of air flow. Thus, upon defrosting, a discharge of air from the channel in the freezer chest is directed out of the circulation path and away from the frozen food items in the chest. When this occurs atmospheric air is drawn into the channel.

In order that the invention will be more clearly understood, it will now be disclosed in greater detail with reference to the accompanying drawings, in which.

Figure 4:
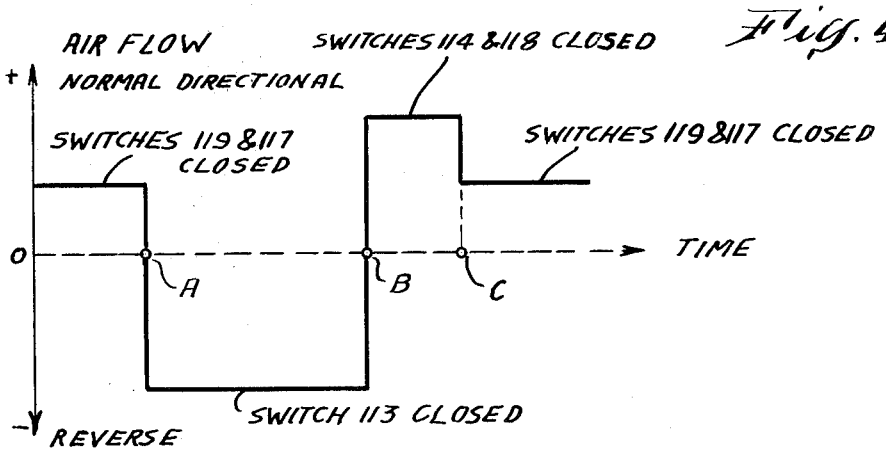
FIGS. 4 and 5 are graphs showing the results of the operations of the timers I and II, respectively, showing the air flow during the periods the defroster and the refrigerator are both on and off.
Figure 5:
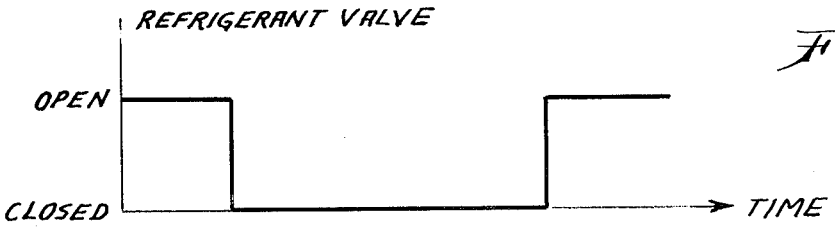

FIGS. 4*a* and 5*a* are graphs based upon the graphical representation shown in FIGS. 4 and 5, respectively, and show the points specifically described with reference to FIGS. 4 and 5.

DESCRIPTION OF THE PREFERRED EMBODIMENTS OF THE INVENTION

Figure 1:
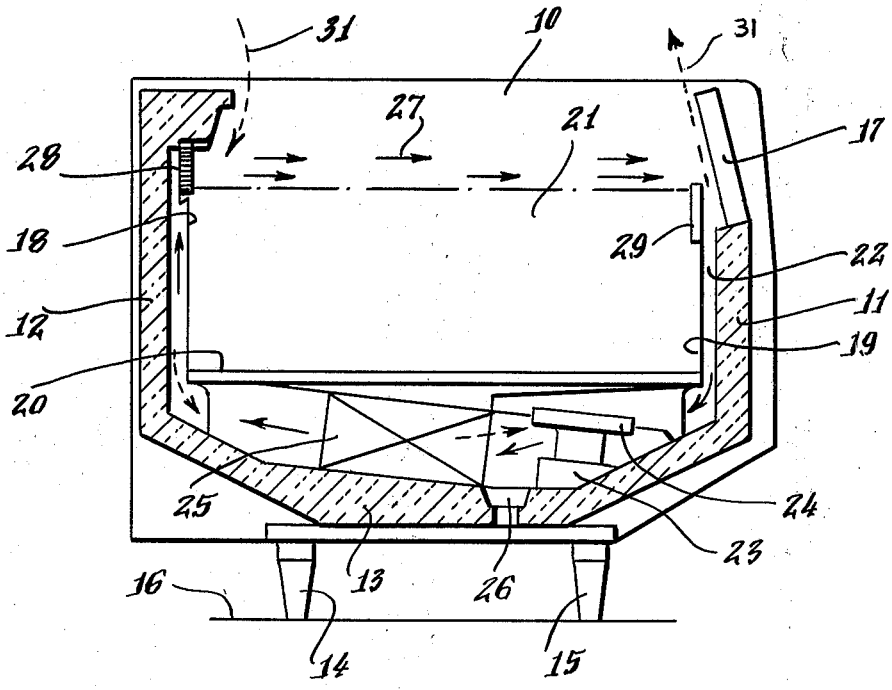
FIG. 1 is a diagrammatic view of a single open-type freezer constructed in accordance with the teachings of the present invention.

Referring to FIG. 1, the freezer shown therein is provided with two end walls 10, only one of which is shown, together with a front wall 11, a rear wall 12 and a bottom surface 13. These walls and surfaces are provided with a suitable heat insulation. The freezer unit is elevated from the floor surface 16 by means of feet 14 and 15 and is intended to be placed in a store, such as a supermarket, in such a way that the customers pass along the right-hand side of the unit shown in FIG. 1. In this connection it should be observed that the front wall 11 is relatively low, but is provided with a top part 17 of insulating glass so that the items in the freezer can be easily seen. The frozen articles to be displayed in the freezer are contained in a sheet metal box having parts 18, 19 and 20 for supporting the frozen items 21.

It should be noted that the sheet metal box 18, 19, 20 is designed and placed relative to the freezer walls 11 and 12 and bottom surface 13 so that an air channel 22 is formed between the box and the walls 11, 12 and bottom surface 13 of the freezer. Furthermore, under the box, and located within the air channel 22, is a fan 24 operated by a motor 23, as well as a cooling element 25. The latter cooling element can be of any known type and therefore is only illustrated diagrammatically. Furthermore, this cooling element comprises pipe coils with fins and is connected to a cooling apparatus of a well-known type in which refrigerant is circulated through the coils.

It should be observed that the bottom of the air channel 22 is inclined toward an outlet 26 for receiving water formed on defrosting of the cooling element 25. In addition, the bottom outlet 26 is connected to a drain system (not shown).

The freezer operates as follows: During normal operation the fan 24 operates in a direction whereby air, as shown by the full line arrows 27, is drawn into the channel 22 on the upper right-hand side of FIG. 1 and proceeds down the channel to the fan 24, through the latter and cooling element 25 to pass upwardly between the rear wall 12 and the sheet metal box 18, 19, 20 with frozen items therein. Thereafter, the air is forced out through guides 28 on the upper left-hand side of FIG. 1 in a horizontal direction over the items located in the freezer. The cooled air is directed by guides 28 toward the intake of the channel 22 located on the right-hand side of FIG. 1. Even if the guides 28 are configured properly and the quantity and velocity of the air are well balanced, the mixing in of warm moist air from the ambient cannot be avoided. When this occurs moisture will successively settle on the cooling element in the form of frost and that element must be defrosted. The latter can be effected in accordance with the teachings of the present invention, partly by causing the air to flow through the channel 22 in a direction opposite to the normal flow direction when operating. This is accomplished partly by interrupting the air circulation and taking in warm ambient air through the guides 28 while the air cooled by the cooling element 25, by way of guides 29 and the insulating glass port 17 at opposite end of the channel, forces the exhaust air in a direction away from the items 21 and away from the previous air circulation path. Thus, air will not flow back to the guides 28 and no circulation of cold air will occur.

The warm ambient air has a considerably higher temperature than the cooling element 25 and thus it can be used for defrosting. However, the ambient warm air's heat content is limted and therefore it is not sufficient if defrosting is to be effected rapidly. Therefore, the present device is so designed that a quantity of air conveyed per unit of time on defrosting is larger than the quantity of air circulated during normal operation. Thus, the quantity of air circulated on defrosting is preferably two to four times larger per unit of time than the normal air volume in the present device.

The motor 23 of the fan 24 is provided with suitable control members, although not shown, in order to obtain a reverse of the flow direction of the air upon defrosting, as shown by the dashed arrows 31. Accordingly, the fan can operate in both directions of rotations and in order to obtain the intended increase of conveyed quantity of air. Furthermore, it is possible, according to the teachings of the present invention, to mount and arrange a motor so as to operate at a higher speed on defrosting than on normal operation. Simultaneously or in place thereof, the fan can be designed to operate with a larger capacity of air on defrosting than during normal operation.

Figure 2:
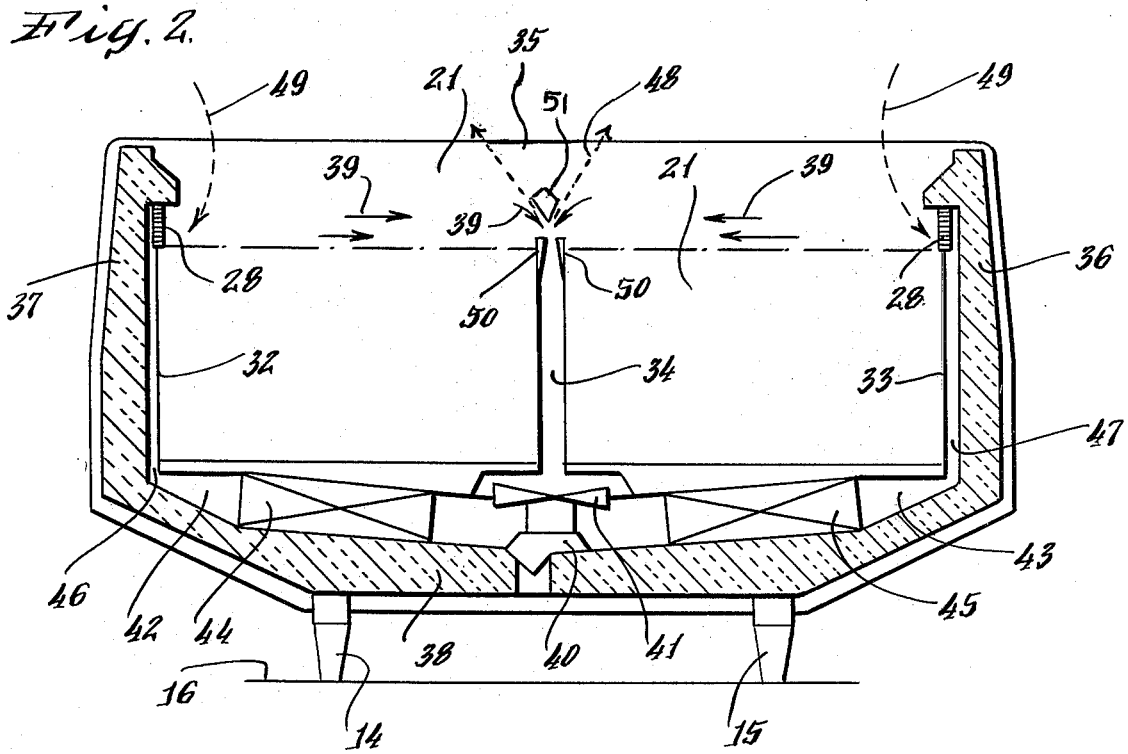
FIG. 2 is another embodiment of the invention shown in FIG. 1, wherein two connected open-type freezer chests are shown.

It is within the scope of the present invention to utilize a freezer which is elongated and in which several fans with motors can be arranged in the air channel. In this construction cooling is carried out by one cooling element adapted to the length of the freezer, or by several elements. Referring now to FIG. 2, a freezer is shown which has two separate display cases for frozen items and each are provided with sheet metal boxes 32 and 33. Between the boxes 32 and 33 is located a partly common, vertical air channel 34. Furtheremore, in this construction, the freezer has two end walls 35, only one of which is shown in FIG. 2, and two long walls 36, 37 designed so as to make the freezer accessible for customers from both sides thereof. The freezer is also provided with a bottom surface 38 and stands with feet 14, 15 on a floor 16. As seen in FIG. 2, during normal operation air is drawn into the unit at the top of the central channel 34 as illustrated by the arrows 39 and moves downward by means of fans 41 which are operated by motors 40 and are common for a continuous channel 42 to the left and a continuous channel 43 to the right. The air in the channel 42 passes through a cooling element 44, while the air present in the channel 43 passes through a cooling element 45 and then moves upwardly through channel sections 46, 47 to be blown out through guides 28 on each side of the unit. As seen in FIG. 2, the air is blown in a horizontal direction over the frozen items 21 and toward a central line above the inlet to the central channel 34 where it is drawn in to the freezer unit to circulate both ways.

When it is desired to defrost the freezer unit, the flow direction of the air is reversed in the channels 42, 43 and 34, and cold air is blown out through the central channel 34 as shown by the dashed arrows 48. As seen in FIG. 2, air is drawn to the guides 28 on both sides of the freezer unit. However, this air is not cold, but warm from the ambient, and the direction of movement is indicated by the arrows 49. Furthermore, specially constructed guides 50 and 51 are shown at the upper opening of the channel 34 in order to direct the air flowing out the freezer unit upon defrosting upwardly and away from the normal circulation path. It should also be noted that the freezer unit shown in FIG. 2 has a bottom surface which is so inclined and constructed that the water formed on defrosting of the cooling element 44, 45 is collected at a location where drain means are provided.

A large quantity of air can be obtained by operating the fans at high speed, and a lower speed of the fans can be obtained by voltage reducing means in the supply wires of the fan motors, for example by means of a transformer or a thyristor control. However, there will be no parallel flow of air over the surface of the freezer items because of the high flow velocity of the air. Thus, a substantial amount of warm air from the atmosphere is drawn in and can be used for defrosting. When the flow direction is reversed and the air velocity is reduced, the flow returns to normal circulation.

Figure 3:
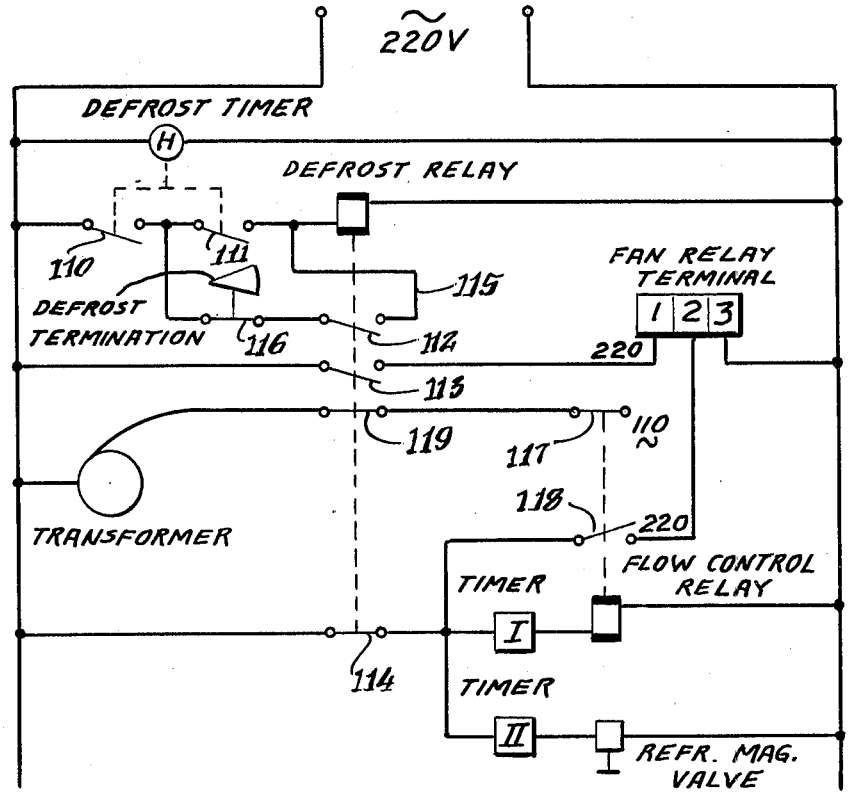
FIG. 3 is a circuit diagram of the fan motor control.

FIG. 3 is a circuit or wiring diagram of the fan motor control, which during normal operation 220 volts A.C. is supplied to the transformer and from the transformer 110 volts A.C. is supplied to the point 2 in the connection terminal. The latter point is connected to one point on a capacitor of the motor (not shown).

The defrost timer H is also operative. When it is time to defrost the freezer, it closes the two contacts 110 and 111, with the contact 110 being disconnected after a few minutes. The defrosting relay is thus energized and this relay closes contacts 112 and 113 and disconnects contacts 114 and 119. Moreover, the contact 112 is located in a conduit 115 bypassing contact 111 and having a contact 116 which is disconnected by a thermostat labelled "defrost termination" when a temperature of, for example, around +5° centrigrade has been reached in the evaporator.

220 volts A.C. is supplied to point 1 in the connection terminal when the contact 113 is closed. Point 1 is connected to a second point of the capacitor at the motor (not shown). The motor is reversed and operates at an increased speed to the higher voltage. When the defrost thermostat becomes active, the contact 116 is disconnected and the defrost relay becomes inactive. Consequently, contacts 112 and 113 are disconnected and contacts 114 and 119 are connected. Thereupon time I becomes active and maintains the air flow control relay closed for a period shown in FIG. 4. The contact 112 and the transformer line is disconnected and the contact 118 is closed so that 220 volts A.C. is supplied to point 2. When this occurs, the fan operates in a normal direction at the increased speed. Thereafter when the timer I breaks the voltage to the air flow control relay, the contacts 117 and 118 switch over and 110 volts A.C. is supplied to point 2, thereby reducing air flow to the normal rate. Timer II thereupon opens the magnetic valve in the refrigerant line, as shown in FIGS. 3 and 5. The contact 119 may be dispensed with, providing the timer I and the timer II are arranged to start when the defrost thermostat disconnects contact 116 and operates as shown in FIGS. 4 and 5 and returns to zero, and being inactive until defrosting is finished.

The cooling elements provide forming of frost in a display chest of the type described herein, however this frost build-up can vary, depending on the temperature of the ambient. Therefore, in order to insure that frost is removed from the elements during defrosting, the flow direction of the air can be reversed back to the normal direction toward the end of defrosting, while keeping the cooling elements shut off and maintaining the large quantity of air circulation per unit time during this relatively short period. This procedure insures that the water formed by thawing during defrosting is removed before the normal operation starts. In order to achieve the foregoing, the control means of the freezer is provided with a retarding means, for example a relay, in order to change the timing at which the velocity of the fan motors is reduced and the cooling compressor is started after defrosting.

Referring now to FIGS. 4 and 5, which show the airflow in the freezer chest and the condition of the refrigerant valve during both the normal cycle and the defrost cycle. At point 0 in FIG. 4, the normal refrigeration of the chest is in existence, having normal airflow, while at the same time, the condensate valve in FIG. 5 is open. At point A of FIG. 4, the defrosting cycle commences and the contact 14 is open, while the contact 13 is closed, and as clearly seen, there is a high airflow in the reverse direction. Simultaneously therewith, the valve of FIG. 5 is closed. At point B in FIG. 4, the defrost cycle ends and the delay cycle begins. Thus, timer I of FIG. 3 starts to operate, and the airflow control relay becomes active, while contact 17 is opened and contact 18 is closed. As seen between point B and point C in FIG. 4 a high airflow in the normal direction is in existence for a short period of time. At the same time, timer II commences to operate and maintains the valve in a closed position, as shown in FIG. 5. At point C in FIG. 4, the airflow in the freezer chest is back to normal operation similar to the airflow shown between points O and A in FIG. 4. Furthermore, switches 19 and 17 are closed during the normal airflow, while the valve of FIG. 5 is opened, and the timer I reset for further cycling.

It is submitted that the present invention is not limited to the embodiments shown and described, but can be modified in many ways within the spirit and scope of the following claims. Thus, although FIGS. 1 and 2 show frozen food chests, the present invention is applicable also to chests containing cooled items. The latter chest may operate in a range above 0° C.

What is claimed is:

1. A method of defrosting cooling elements in an open type freezer chest having at least one fan for circulating air through channels in said chest and over the open side of said chest, and above items stored therein comprising: shutting down the refrigerant supply to the cooling elements, moving said air in the channel in a direction opposite to the normal direction of flow, flowing said air cooled by said cooling elements out of the circulation path and in a direction away from said stored items, drawing in ambient air into at least one place in said freezer chest where air was blown out previously, projecting a larger quantity of air per unit time during defrosting in said channels in said freezer chest than during normal air circulation therein, at the end of the defrosting cycle reversing the direction of airflow to the normal direction while maintaining the cooling elements in an inoperative condition, propelling a large quantity of air per unit time in said normal direction for a short period relative to the time period of the larger quantity of air projected during defrosting, and thereafter reducing the air quantity to an amount required for normal operation.

2. A method of defrosting cooling elements in an open type freezer chest as claimed in claim 1 wherein said fan is provided with a fan motor having two different speeds.

3. A method of defrosting cooling elements in an open type freezer chest as claimed in claim 1 wherein said fan is reversible.

4. A method of defrosting cooling elements in an open type freezer chest as claimed in claim 1 further comprising the step of reversing the direction of air flow to the normal direction at the end of the defrost cycle while maintaining the cooling elements in an inoperative condition, and sustaining a large quantity of air per unit time for a relatively short period before the air quantity is reduced to an amount required for normal operation.

* * * * *